United States Patent [19]

Yagi et al.

[11] 4,267,220

[45] May 12, 1981

[54] DUST-CONTROLLING MAT HAVING GOOD FLAME-PROOFNESS

[75] Inventors: Akira Yagi, Takatsuki; Ichiro Miyoshi, Kobe; Nobusue Nogami, Kyoto, all of Japan

[73] Assignee: Duskin Franchise Co., Ltd., Osaka, Japan

[21] Appl. No.: 110,531

[22] Filed: Jan. 8, 1980

[51] Int. Cl.[3] ..... B32B 3/02

[52] U.S. Cl. ..... 428/96; 428/97; 428/921

[58] Field of Search ..... 428/96, 97, 921

[56] References Cited

U.S. PATENT DOCUMENTS 3,306,808 2/1967 Thompson ..... 428/97

*Primary Examiner*—Marion McCamish

*Attorney, Agent, or Firm*—Sherman & Shalloway

[57] ABSTRACT

Disclosed is a dust-controlling mat comprising tufted pile yarns containing fibers composed of a grafting product or polymer blend of polyvinyl alcohol and polyvinyl chloride and a dust adsorbing agent retained in the tufted pile yarns in an amount of 1 to 40% by weight based on the tufted piled yarns. This dust-controlling mat has an excellent dust-controlling property and a highly improved flame-proofing property in combination.

10 Claims, No Drawings

DUST-CONTROLLING MAT HAVING GOOD FLAME-PROOFNESS

BACKGROUND OF THE INVENTION (1) Field of the Invention

The present invention relates to a mat having a good flame-proofness and a good dust-controlling property in combination. More particularly, the present invention relates to a dust-controlling mat comprising tufted pile yarns of fibers composed of a grafting product or polymer blend including polyvinyl alcohol and polyvinyl chloride.

(2) Description of the Prior Art

Dust-controlling mats are placed in the vicinity of entrances of stores, hospitals, offices and other buildings for the service trade and used for preventing dusts from intruding into these buildings from the outside. These dust-controlling mats are ordinarily prepared by tufting pile yarns to a base fabric, fixing the tufts by a packing of a synthetic rubber and coating or impregnating the tufted yarns with a dust-controlling composition containing an oiling agent. Fibers to be used for tufting should have a property of adsorbing and retaining an oiling agent therein. For this reason, flammable fibers such as cotton fibers and Vinylon fibers (polyvinyl alcohol fibers) have been mainly used. Furthermore, these flammable fibers are coated or impregnated with an oiling agent which also is flammable. Therefore, the conventional dust-controlling mats catch fire easily and are very poor in the flame-proofness.

Recently, regulations of the flame-proofness to matting articles have become stringent for fire prevention in urban communities, and the Fire Services Act and related laws stipulate that matting articles used at multi-storied buildings, underground markets and buildings and halls where many and unspecified persons gather should have a certain flame-proofness.

Accordingly, various attempts have heretofore been made to improve the flame-proofness in dust-controlling mats. According to most of these conventional attempts, flame-proofing agents are incorporated into dust adsorbing oiling agent compositions. For example, the specification of U.S. Pat. No. 3,391,097 discloses a process in which a flame-proofing agent composed of an antimony-phosphorus pentoxide complex or the like is mixed with a mineral oil and an emulsifier to form a dust-collecting self-emulsifiable oiling agent composition and a cellulose fiber mat is treated with an aqueous emulsion of this oiling agent composition to form a dust-controlling mat, that is, a so-called walk-off mat.

Indeed, this flame-proofing mat is improved over mats prepared by using an oiling agent composition free of a flame-proofing agent with respect to the flame-proofness. However, since the constituent fibers are very easily flammable, the flame-proofness is still insufficient. Furthermore, this mat is defective in that the durability of the flame-proofness is poor.

It may be considered that the foregoing defects will be overcome by using flame-proofing or flame-retardant fibers as the constituent fibers. However, most of available flame-proofing or flame-retardant fibers lack the property of adsorbing and retaining dust absorbing agents such as the above-mentioned oiling agents, and when they are used for dust-controlling mats, a sufficient dust adsorbing property or dust retaining property cannot be obtained. Moreover, in dust-controlling mats prepared by using these flame-proofing or flame-retardant fibers, the dust adsorbing agent such as an oiling agent is readily transferred to boot soles and the like and the portion near the place where the mat is placed is readily contaminated.

SUMMARY OF THE INVENTION

We found that when fibers composed of a grafting product or polymer blend of polyvinyl alcohol and polyvinyl chloride are selected as the fibrous substrate and these fibers are coated or impregnated with a dust adsorbing agent, the applied dust adsorbing agent is effectively adsorbed and retained in the surfaces of these fibers and a dust-controlling mat having an excellent dust-controlling property and a highly improved flame-proofing property can be obtained.

It is a primary object of the present invention to provide a dust-controlling mat having a good flame-proofing property and a good dust-controlling property (good dusting property) in combination.

Another object of the present invention is to provide a dust-controlling mat in which even if it is coated or impregnated that a dust adsorbing agent comprising an easily flammable mineral oil or synthetic oil, a high durable flame-proofness is obtained, migration of the dust adsorbing agent to boot soles and the like is controlled to a negligible level and a good dust-controlling property is maintained stably for a relatively long time.

In accordance with the present invention, there is provided a dust-controlling mat comprising tufted pile yarns containing fibers composed of a grafting product or polymer blend of polyvinyl alcohol and polyvinyl chloride and a dust adsorbing agent retained in said pile yarns in an amount of 1 to 40% by weight based on said pile yarns.

DETAILED DESCRIPTION OF THE PREFERRED EMBODIMENTS

It is one of important characteristic features of the present invention that fibers composed of a grafting product or polymer blend of polyvinyl alcohol and polyvinyl chloride are used as the constituent fibers of pile yarns. These fibers are obtained by forming a spinning solution comprising an emulsion containing polyvinyl chloride and polyvinyl alcohol, wet-spinning the spinning solution according to a method customarily adopted for manufacture of polyvinyl alcohol fibers, and if desired, heat-drawing the spun fibers and acetalizing the fibers.

More specifically, monomeric vinyl chloride is dispersed in an aqueous solution of polyvinyl alcohol to form an emulsion, and emulsion polymerization is carried out in the presence of a known radical polymerization initiator. By this emulsion polymerization, a part of formed polyvinyl chloride is grafted to polyvinyl alcohol. The emulsion obtained by this emulsion polymerization of vinyl chloride, that is, an emulsion of polyvinyl chloride-polyvinyl alcohol, is mixed with an aqueous solution of polyvinyl alcohol as the matrix to form a spinning solution. The solid content in this spinning solution may be 10 to 20% by weight.

This spinning solution is extruded in a coagulating solution, for example, a concentrated aqueous solution of borax, through spinning nozzles and the extrudate is coagulated, whereby wet spinning can be accomplished very easily. The as-spun fibers have a structure in which polyvinyl chloride particles are dispersed in polyvinyl alcohol as the matrix. When the as-spun fibers are drawn under heating, the polyvinyl chloride particles are combined with one another and there is formed a micro-structure in which polyvinyl alcohol is present in the form of fibrils in the polyvinyl alcohol matrix. Accordingly, the physical characteristics of the fibers are improved by this heat drawing. When the heat-drawn fibers are acetalized according to a method customarily adopted for polyvinyl alcohol fibers, the hot water resistance of the fibers can be further improved.

It is preferred that fibers composed of a grafting product or polymer blend of polyvinyl alcohol and polyvinyl chloride be mix-spun fibers in which polyvinyl chloride is present in the form of fibrils in a matrix of polyvinyl alcohol as described above.

In order to attain the objects of the present invention, it is very important that such mix-spun fibers should comprise 30 to 70% by weight, preferably 40 to 60% by weight, of the polyvinyl alcohol component and 70 to 30% by weight, preferably 60 to 40% by weight, of the polyvinyl chloride component. If the amount of the polyvinyl alcohol component is smaller than 30% by weight, it is difficult to adsorb and retain a dust adsorbing agent sufficiently in the fibers, and it is often impossible to obtain a sufficient dust adsorbing effect or dust retaining capacity.

In the instant specification, by the term "dust adsorbing effect" is meant an effect of adsorbing dusts adhering to boot soles or the like in tufted pile yarns, and by the dust retaining capacity is meant a property of retaining dusts once adsorbed in tufted pile yarns without being released therefrom.

When the amount of the polyvinyl chloride component is smaller than 30% by weight, the flame-proofness becomes insufficient.

The molecular weight of polyvinyl alcohol forming the matrix is not particularly critical, so far as polyvinyl alcohol has a fiber-forming molecular weight. Ordinarily, polyvinyl alcohol has an average degree of polymerization of 1000 to 3000, especially 1500 to 2000. Since polyvinyl chloride is prepared by emulsion polymerization as pointed out hereinbefore, it has a relatively high molecular weight suitable for formation of fibrils. Ordinarily, polyvinyl chloride has an average degree of polymerization of 500 to 3000.

When mix-spun fibers in which polyvinyl chloride is present in the form of fibrils in a matrix of polyvinyl alcohol are used according to the preferred embodiment of the present invention, various advantages can be attained. For example, when fibers having such specific micro-structure are used for tufted pile yarns of a dust-controlling mat, there can be obtained pile yarns having an elasticity suitable for the dust-controlling activity, and properties of adsorbing and retaining a dust adsorbing agent can be remarkably improved.

Mix-spun fibers especially suitable for attaining the objects of the present invention are those manufactured and sold under the tradename "Cordelan" by Kojin Kabushiki Kaisha.

Mix-spun fibers of polyvinyl alcohol (PVA) and polyvinyl chloride (PVC) are preferably used in the form of staple fibers having a fineness of 2 to 100 denier and a cut length of 30 to 170 mm, and spun yarns of these fibers are used as pile yarns for tufting. Staples of the above-mentioned mix-spun fibers may be singly spun and used as pile yarns. Furthermore, these staple fibers may be mixed with cotton fibers, polyvinyl alcohol fibers, rayon fibers or the like by blend spinning or blend twisting. In this case, in order to attain a sufficient flame-proofness, it is preferred that yarns of PVA-PVC mix-spun fibers occupy at least 10% by weight, particularly at least 20% by weight, of the whole spun yarns.

From the viewpoints of the dust-controlling capacity, flame-proofness, touch and appearance and also from the economical viewpoint, it is preferred to use spun yarns comprising PVA-PVC mix-spun fibers and polyvinyl alcohol fibers at a weight ratio of from 10:90 to 70:30, particularly from 20:80 to 60:40.

A substrate of the dust-controlling mat is formed by tufting spun yarns such as mentioned above to a base fabric to form pile yarns, fixing the tufted pile yarns to the back surface of the base fabric by a packing of a synthetic rubber or synthetic resin and, if desired, trimming the top ends of the pile yarns.

As the base fabric, there may be used nets and woven fabrics of synthetic fibers such as polyester fibers and polypropylene fibers, non-woven fabrics, plastic nets and metal wire nets. Spun yarns are tufted in an amount of 300 to 2000 g/m$^2$ and the pile length is adjusted to 2 to 30 mm by cutting. As the packing, there are preferably used packings of synthetic rubbers such as styrene-butadiene rubber, nitrile-butadiene rubber, chloroprene rubber and butyl rubber. The packing is applied to the base fabric in the form of a latex.

As the dust adsorbing agent, there are used substantially non-drying oiling agents, and there are preferably employed mineral and vegetable lubricating oils and synthetic lubricating oils. As the mineral oiling agent, there can be mentioned, for example, refrigerating oil, spindle oil, machine oil, liquid paraffin and insulating oil, and as the vegetable oiling agent, there can be mentioned, for example, castor oil and cotton seed oil. Furthermore, there may be used synthetic oils such as alkylbenzene oil, diolefin oil, diester oil and alkyl naphthenate oil. These oiling agents may be used singly or in the form of a mixture of two or more of them. Although these oiling agents are easily flammable, an excellent flame-proofness can be obtained according to the present invention.

As another type of the dust adsorbing agent, there can be mentioned organic phosphoric acid esters having a viscosity of 10 to 500 cP as measured at 20° C., especially those represented by the following general formula:

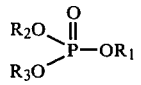

wherein $R_1$ stands for a hydrogen atom, a monovalent hydrocarbon group or a monovalent halogenated hydrocarbon group, and $R_2$ and $R_3$ each stand for a monovalent hydrocarbon group or a monovalent halogenated hydrocarbon group or a monovalent halogenated hydrocarbon group.

As specific examples of the phosphoric acid ester represented by the above general formula, there can be mentioned tricresyl phosphate, triphenyl phosphate, cresyldiphenyl phosphate, octyldiphenyl phosphate, tris-methyl phosphate, tris-ethyl phosphate, tris-butyl phosphate, tris-octyl phosphate, tris-(chloroethyl)phosphate, tris-(dichloropropyl)phosphate, tris-(chloropropyl)phosphate, tris-(2,3-dibromopropyl)phosphate, bis-(2,3-dibromopropyl)-2,3-dichloropropyl phosphate, diethyl phosphate and dipropyl phosphate. In addition, there can be used tris-(butoxy-2-ethyl)phosphate, tris- (propoxy-2-ethyl)phosphate and diethylacetamide phosphate.

As another preferred type of organic phosphoric acid esters are represented by the following general formula:

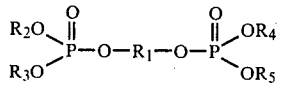

wherein $R_1$ stands for an alkylene group which may contain an intervening ether oxygen atom and each of $R_2$, $R_3$, $R_4$ and $R_5$, which may be same or different each other, is a haloalkyl group, e.g. tetrakis(2-chloroethyl)ethylenglycol diphosphate, tetrakis(2-chloroethyl)diethylenglycol diphosphate.

A mildew-proofing agent, a surface active agent, a perfume and other additives may be incorporated into the dust adsorbing agent, if desired.

The amount of the dust adsorbing agent is selected within the range of 1 to 40% by weight, especially 5 to 20% by weight, based on the pile yarns.

The dust adsorbing agent (also called "dust-controlling agent") may be applied to the mat according to known methods such as roll coating, spraying and dipping.

The present invention will now be described in detail with reference to the following Examples that by no means limit the scope of the invention.

EXAMPLE 1

Blend-twisted yarns of Cordelan (PVA-PVC mix-spun fibers manufactured by Kojin K. K.) and Vinylon (PVA fibers manufactured by Kuraray K. K.) (Cordelan/Vinylon=54/46) were tufted to a polyester plain weave fabric [gauge (hereinafter referred to as "G")=5/32, stitch (hereinafter referred to as "ST")=13.7, pile height (hereinafter referred to as "PH")=6 mm and tufted amount (hereinafter referred to as "TA")=about 850 g/m$^2$], and the tufted yarns were fixed by using an NBR latex (manufactured by Takeda Yakuhin K. K.) as the packing to form a flame-proofing mat. Then, the mat was coated with spindle oil 60 (manufactured by Mitsubishi Sekiyu K. K.) as the dust-controlling agent in an amount of 10% by weight based on the tufted pile yarns. The mat was subjected to the flame-proofness test according to the air mix burner method stipulated in Article 4-3 of Enforcement Regulations of Fire Services Act before and after coating of the dust-controlling agent.

According to this test method, a sample mat is inclined at an angle of 45° and contacted with flames of an air-mixed burner for 30 seconds. Therefore, test conditions adopted in this method are severer than conditions adopted in the method of ASTM E-84 and DOC FF-1-70 and DOC FF-2-70 where a sample is ignited in the horizontal state.

It is stipulated that at the above-mentioned flame-proofness test, the afterflame time should be shorter than 20 seconds and the char length should be shorter than 10 cm.

Obtained results are shown in Table 1.

TABLE 1

| | Before Coating | | After Coating | |
|---|---|---|---|---|
| | Afterflame Time (sec) | Char Length (cm) | Afterflame Time (sec) | Char Length (cm) |
| Longitudinal Direction | 0.6 | 4.9 | 0.9 | 5.4 |
| Longitudinal Direction | 0.5 | 4.7 | 0.6 | 5.6 |
| Longitudinal Direction | 0.5 | 4.6 | 0.8 | 5.6 |
| Lateral Direction | 0.4 | 4.6 | 0.6 | 5.3 |
| Lateral Direction | 0.5 | 4.6 | 0.7 | 5.8 |
| Lateral Direction | 0.6 | 4.8 | 0.7 | 4.8 |

As will be apparent from the results shown in Table 1, even the mat samples coated with the oiling agent could stand both the afterflame time and char length tests, as well as the uncoated mat samples.

When the mat samples were placed at entrances of a super-market for 5 days, it was found that the dust controlling agent-coated mat was much more blackened than the uncoated mat. The weight of dusts collected from the coated mat was 86 g, whereas the weight of dusts collected from the uncoated mat was 71 g.

EXAMPLE 2

Blend-spun yarns of flame-proofing PVA-PVC mix-spun fibers (Cordelan) and PVC fibers (Vinylon) (25% by weight of Cordlan and 75% by weight of Vinylon) were tufted to a polyester plain weave fabric (G=5/32, ST=8.5, PH=10 mm and TA=about 660 g/m$^2$) and fixed to the polyester fabric by using an NBR latex as the packing. Then, the tufted pile yarns were roll-coated with a silicone oil (KF-96 manufactured by Shinetsu Kagaku Kogyo K. K.) in an amount of 10% by weight based on the pile yarns, a fatty acid ester type flame-proofing oiling agent (Unistar H381 manufactured by Nippon Yushi K. K.) in an amount of 20% by weight based on the pile yarns or tetra-kis-(2-chloroethyl) ethylene glycol diphosphate (Nonnen C-18 manufactured by Marubishi Yuka Kogyo K. K.) in an amount of 10% by weight based on the pile yarns. The so prepared mats were subjected to the flame-proofness test in the same manner as described in Example 1. Obtained results are shown in Table 2.

TABLE 2

| | Uncoated | | KF-96 | | Unistar H381 | | Nonnen C-18 | |
|---|---|---|---|---|---|---|---|---|
| | Afterflame Time (sec) | Char Length (cm) | Afterflame Time (sec) | Char Length (cm) | Afterflame Time (sec) | Char Length (cm) | Afterflame Time (sec) | Char Length (cm) |
| Longitudinal Direction | 0.4 | 5.8 | 0.5 | 6.9 | 0.5 | 5.4 | 0.4 | 5.6 |
| Longitudinal Direction | 0.6 | 5.9 | 0.5 | 6.3 | 0.5 | 6.0 | 0.5 | 5.6 |
| Longitudinal Direction | 0.6 | 6.2 | 0.6 | 6.4 | 0.6 | 5.3 | 0.4 | 5.4 |
| Lateral Direction | 0.5 | 6.2 | 0.7 | 6.0 | 0.6 | 5.4 | 0.4 | 5.2 |

TABLE 2-continued

| | Uncoated | | KF-96 | | Unistar H381 | | Nonnen C-18 | |
|---|---|---|---|---|---|---|---|---|
| | After-flame Time (sec) | Char Length (cm) | After-flame Time (sec) | Char Length (cm) | After-flame Time (sec) | Char Length (cm) | After-flame Time (sec) | Char Length (cm) |
| Lateral Direction | 0.6 | 6.0 | 0.5 | 5.4 | 0.6 | 5.7 | 0.4 | 5.6 |
| Lateral Direction | 0.6 | 6.1 | 0.5 | 5.6 | 0.6 | 5.2 | 0.4 | 5.5 |

From the results shown in Table 2, it is seen that when the phosphate type flame-proofing oiling agent and other oiling agents were coated, there were obtained dust-controlling mats that could stand both the afterflame and char length tests (standard values are described in Example 1).

EXAMPLE 3

Blend-twisted yarns of Cordelan and Vinylon (54% by weight of Cordelan and 46% by weight of Vinylon) were tufted to a polyester plain weave fabric (G=5/32, ST=8.5, PH=10 mm and TA=about 770 g/m$^2$) and fixed by using a packing of an NBR latex. A mixture comprising 70 parts by weight of tris-octyl phosphate (manufactured by Daihachi Kagaku Kogyosho K. K.), 29 parts by weight of spindle oil 60 and 1 part by weight of butyl p-hydroxybenzoate (manufactured by Ueno Seiyaku K. K.) was spray-coated as the dust-controlling agent on the so-formed mat in an amount of 5% by weight based on the pile yarns. The coated mat was set at an entrance of a certain office for 1 week, and then, the mat was washed and dried and the above dust-controlling agent was spray-coated again on the mat in an amount of 5% by weight based on the pile yarns. The mat was set at the same place for 1 week and was then treated in the same manner as described above. The above procedures were repeated 10 times and the mat was subjected to the flame-proofness test in the same manner as described in Example 1. The untreated mat was similarly treated and tested.

In each run, the dust-controlling agent-coated mat was much more blackened than the uncoated mat and it was confirmed that the coated mat was more effective for adsorbing and retaining dusts than the uncoated mat.

Results obtained at the flame-proofness test are shown in Table 3.

TABLE 3

| | Uncoated Mat before Repetition of Dust Collection and Washing | | Coated Mat before Repetition of Dust Collection and Washing | | Uncoated Mat After Repetition of Dust Collection and Washing | | Coated Mat after Repetition of Dust Collection and Washing | |
|---|---|---|---|---|---|---|---|---|
| | afterflame time (sec) | char length (cm) | afterflame time (sec) | char length (cm) | afterflame time (sec) | char length (cm) | afterflame time (sec) | char length (cm) |
| longitudinal direction | 0.6 | 5.0 | 0.5 | 5.2 | 0.5 | 5.3 | 0.6 | 5.7 |
| longitudinal direction | 0.5 | 5.2 | 0.5 | 4.8 | 0.6 | 5.6 | 0.5 | 5.9 |
| longitudinal direction | 0.5 | 5.6 | 0.4 | 5.3 | 0.6 | 5.2 | 0.5 | 5.2 |
| lateral direction | 0.5 | 5.3 | 0.5 | 5.1 | 0.5 | 5.1 | 0.5 | 5.6 |
| lateral direction | 0.6 | 5.2 | 0.6 | 5.1 | 0.5 | 5.4 | 0.6 | 5.2 |
| lateral direction | 0.5 | 5.2 | 0.5 | 5.3 | 0.6 | 5.5 | 0.5 | 5.1 |

EXAMPLE 4

Blend-twisted yarns of Cordelan and cotton/rayon (85/15) (56% by weight of Cordelan) were tufted to a polyester plain weave fabric (G=5/32, ST=11.1, PH=6 mm and TA=about 690 g/m$^2$) and fixed by using an NBR latex as the packing. The mat was spray-coated with spindle oil 60, tris-octyl phosphate or Nonnen C-18 as the dust-controlling agent in an amount of 10% by weight based on the pile yarns. The resulting coated mats and uncoated mat were subjected to the fire-proofness test in the same manner as described in Example 1 to obtain results shown in Table 4.

From the results shown in Table 4, it will readily be understood that when blend-twisted yarns of Cordelan and cotton/rayon were used as the pile yarns, the resulting dust-controlling agent-coated mats could stand both the afterflame time and char length tests (standard values are described in Example 1).

TABLE 4

| | Uncoated | | Spindle Oil 60 | | Tris-Octyl Phosphate | | Nonnen C-18 | |
|---|---|---|---|---|---|---|---|---|
| | afterflame time (sec) | char length (cm) | afterflame time (sec) | char length (cm) | afterflame time (sec) | char length (cm) | afterflame time (sec) | char length (cm) |
| Longitudinal | | | | | | | | |

TABLE 4-continued

| | Uncoated | | Spindle Oil 60 | | Tris-Octyl Phosphate | | Nonnen C-18 | |
|---|---|---|---|---|---|---|---|---|
| | afterflame time (sec) | char length (cm) | afterflame time (sec) | char length (cm) | afterflame time (sec) | char length (cm) | afterflame time (sec) | char length (cm) |
| Direction Longitudinal | 2.8 | 4.1 | 8.7 | 4.7 | 3.1 | 4.9 | 0.8 | 4.4 |
| Direction Longitudinal | 4.2 | 4.4 | 6.3 | 4.6 | 3.6 | 4.4 | 1.2 | 4.2 |
| Direction Lateral | 2.5 | 4.5 | 6.6 | 4.9 | 2.8 | 4.4 | 1.7 | 4.2 |
| Direction Lateral | 3.5 | 4.3 | 5.6 | 4.9 | 4.4 | 4.7 | 1.8 | 4.0 |
| Direction Lateral | 2.6 | 4.2 | 5.9 | 4.6 | 3.9 | 5.3 | 1.5 | 4.1 |
| Direction | 2.5 | 4.2 | 7.1 | 5.1 | 4.0 | 4.8 | 1.5 | 4.0 |

EXAMPLE 5

Yarns composed solely of Vinylon fibers, which have heretofore been used for dust-controlling mats, were tufted to a polyester plain weave fabric (G=5/32, ST=8.5, PH=10 mm and TA=about 660 g/m$^2$) and fixed by using an NBR latex as the packing. The resulting mat was spray-coated with spindle oil 60, chlorinated paraffin (Toyoparax 145 manufactured by Toyo Soda Kogyo K. K.) or tris-octyl phosphate as the dust-controlling agent in an amount of 10% by weight based on the pile yarns. The coated mats and uncoated mat were subjected to the flame-proofness test in the same manner as described in Example 1 to obtain results shown in Table 5.

From the results shown in Table 5, it will readily be understood that mats comprising tufted pile yarns free of mix-spun fibers of the present invention could not stand the afterflame time and char length tests (standards values are described in Example 1), whether or not they contained the dust-controlling agent.

TABLE 5

| | Uncoated | | Spindle Oil 60 | | Toyoparax 145 | | Tris-Octyl | |
|---|---|---|---|---|---|---|---|---|
| | afterflame time (sec) | char length (cm) | afterflame time (sec) | char length (cm) | afterflame time (sec) | char length (cm) | afterflame time (sec) | char length (cm) |
| Longitudinal Direction | ∞ | ∞ | ∞ | ∞ | ∞ | ∞ | ∞ | ∞ |
| Longitudinal Direction | ∞ | ∞ | ∞ | ∞ | ∞ | ∞ | ∞ | ∞ |
| Lateral Direction | ∞ | ∞ | ∞ | ∞ | ∞ | ∞ | ∞ | ∞ |
| Lateral Direction | ∞ | ∞ | ∞ | ∞ | ∞ | ∞ | ∞ | ∞ |
| Lateral Direction | ∞ | ∞ | ∞ | ∞ | ∞ | ∞ | ∞ | ∞ |
| Direction | ∞ | ∞ | ∞ | ∞ | ∞ | ∞ | ∞ | ∞ |

What we claim is:

1. A dust-controlling mat comprising tufted pile yarns containing fibers composed of a grafting product or polymer blend of polyvinyl alcohol and polyvinyl chloride and a dust adsorbing agent retained in said pile yarns in an amount of 1 to 40% by weight based on said pile yarns.

2. A dust-controlling mat as set forth in claim 1 wherein said grafting product or polymer blend comprises 30 to 70% by weight of polyvinyl alcohol and 70 to 30% by weight of polyvinyl chloride.

3. A dust-controlling mat as set forth in claim 1 wherein said fibers of the grafting product or polymer blend are mix-spun fibers having a micro-structure in which polyvinyl chloride is present in the form of fibrils in a matrix of polyvinyl alcohol.

4. A dust-controlling mat as set forth in claim 3 wherein said pile yarns are blend-spun yarns comprising fibers of said grafting product or polymer blend and other synthetic or natural fibers and the amount of fibers of said grafting product or polymer blend is 10 to 100% by weight based on the pile yarns.

5. A dust-controlling mat as set forth in claim 3 wherein said pile yarns are blend-spun yarns comprising fibers of said grafting product or polymer blend and polyvinyl alcohol fibers at a weight ratio of from 10:90 to 70:30.

6. A dust-controlling mat as set forth in claim 1 wherein said pile yarns are blend-spun yarns comprising fibers of said grafting product or polymer blend and other synthetic or natural fibers and the amount of fibers of said grafting product or polymer blend is 10 to 100% by weight based on the pile yarns.

7. A dust-controlling mat as set forth in claim 1 wherein said pile yarns are blend-spun yarns comprising fibers of said grafting product or polymer blend and polyvinyl alcohol fibers at a weight ratio of from 10:90 to 70:30.

8. A dust-controlling mat as set forth in claim 1 wherein said dust adsorbing agent is a lubricating oil of the synthetic oil or mineral oil type.

9. A dust-controlling mat as set forth in claim 1 wherein said dust adsorbing agent is an oiling agent comprising an organic phosphoric acid ester.

10. A dust-controlling mat comprising a base fabric, pile yarns formed by tufting spun yarns to said base fabric and a packing of a synthetic rubber or synthetic resin for fixing the pile yarns to the base fabric, wherein said pile yarns are spun yarns containing at least 10% by weight of staples of mix-spun fibers comprising 30 to 70% by weight of polyvinyl alcohol and 70 to 30% by weight of polyvinyl chloride, said mix-spun fibers have a micro-structure in which polyvinyl chloride is present in the form of fibrils in a matrix of polyvinyl alcohol, a dust adsorbing agent is adsorbed and retained in said pile yarns in an amount of 1 to 40% by weight based on said pile yarns, and dust adsorbing agent is a lubricating oil of the synthetic oil or mineral oil type or an organic phosphoric acid ester.

* * * * *